United States Patent [19]

Angeloff

[11] Patent Number: 4,771,817

[45] Date of Patent: Sep. 20, 1988

[54] DEPLOYMENT AND RETRACTION ARRANGEMENT FOR A SLOT COVER

[75] Inventor: Lloyd G. Angeloff, North Merrick, N.Y.

[73] Assignee: Grumman Aerospace Corporation, Bethpage, N.Y.

[21] Appl. No.: 15,899

[22] Filed: Feb. 18, 1987

[51] Int. Cl.[4] ..... E06B 9/17

[52] U.S. Cl. ..... 160/266; 160/133; 160/241

[58] Field of Search ..... 160/266, 133, 241, 238, 160/242

[56] References Cited

U.S. PATENT DOCUMENTS

| | | | |
|---|---|---|---|
| 862,644 | 8/1907 | Kepler . | |
| 2,002,944 | 5/1935 | Hathorn . | |
| 2,104,321 | 1/1938 | Gersten . | |
| 2,472,156 | 6/1949 | Gerber . | |
| 2,792,599 | 5/1957 | Gantschnigg et al. . | |
| 3,473,758 | 10/1969 | Webb . | |
| 3,525,483 | 8/1970 | Van Alstyne | 244/173 |
| 3,817,477 | 6/1974 | Luther et al. . | |
| 3,882,921 | 5/1975 | Sandall | 160/266 |
| 4,015,653 | 4/1977 | Slysh et al. | 160/213 |
| 4,116,258 | 9/1978 | Slysh et al. | 160/213 |
| 4,244,417 | 1/1981 | Taylor . | |
| 4,373,690 | 2/1983 | Stillman et al. . | |

*Primary Examiner*—Ramon S. Britts

*Assistant Examiner*—Blair M. Johnson

*Attorney, Agent, or Firm*—Scully, Scott, Murphy & Presser

[57] ABSTRACT

A deployment and retraction arrangement for a slot cover which is adapted to cover or seal a longitudinally extending slot or space present between at least two adjacent located membranes or panels. More particularly, the arrangement is a rollable deployment and retraction arrangement for selectively deploying and retracting a slot cover employed for covering a slot or space present intermediate two adjacent membranes or panels so as to, preferably, prevent any FR leakage through the slot during radar operation of the panels. The slot cover structure includes an elongated cover member consisting of upper and lower cover portions which are centrally fastened to each other along the longitudinal axis thereof, and with the cover portions being configured in transverse cross-section such that, in the extended deployed position of the slot cover, the upper and lower cover portions have clamshell configurations extending from the central axis, whereby the outer edges of the cover portions come into surface-engaging clamping contact with the surfaces of the applicable membrane or panel which is interposed therebetween, so as to be in essentially slot closing or sealing relationship therewith, and to thereby inhibit any FR leakage through the slot present between the panels, during radar operation.

10 Claims, 6 Drawing Sheets

DEPLOYMENT AND RETRACTION ARRANGEMENT FOR A SLOT COVER

BACKGROUND OF THE INVENTION

1. Field of the Invention

The present invention relates to a deployment and retraction arrangement for a slot cover which is adapted to cover or seal a longitudinally extending slot or space present between at least two adjacent located membranes or panels. More particularly, the invention relates to a rollable deployment and retraction arrangement for selectively deploying and retracting a slot cover employed for covering a slot or space present intermediate between two adjacent membranes or panels so as to prevent any RF leakage through the slot during radar operation of the panels.

Moreover, the inventive arrangement for selectively deploying and retracting a slot cover between membranes or panels, has a structural sealing ability imparted thereto which can be readily employed to prevent any passage or leakage of light, dust or moisture through the slot between the adjacent panels, while; in addition, upon suitable material selection for the slot cover, being able to be utilized as a medium enabling the transmission of electrical power to adjacent panels or for establishing electrical continuity between adjacent panels.

Although numerous types of mechanical and electromechanical systems and arrangements are currently employed in the technology for the deployment and retraction of panels, membranes or screens and the like, none of these are directed to the provision of an arrangement which will, with a high degree of assurance and dependability, prevent any leakage through any slot or space which exists between adjacent deployed membranes or panels, dependent upon the material selected for the slot cover.

2. Discussion of the Prior Art

Slysh, et al. U.S. Pat. No. 4,116,258 discloses a panel deployment and retraction system in which a plurality of isogrid panels are adapted to be retracted into a folded accordian-like stowed panel stack, and selectively extended so as to be deployed into a planar surface through the utilization of articulated connector components which are responsive to an electrical actuating system. There is no disclosure of a slot cover which, in the extended deployed condition thereof, will clampingly and sealing engage the contacting edges of panels or membranes analogous to the concept of the present invention.

Similarly, Slysh, et al. U.S. Pat. No. 4,015,653 discloses a deployment system for foldable panels, in which a plurality of articulated panel or shutter members are adapted to be selectively extended and deployed into an operative layflat position or retracted into a folded stowed position. There is no disclosure of a slot cover deploying arrangement, in which the deployed slot cover will prevent leakage through the slot or which may be present between adjacent deployed membranes or panels.

Sandall U.S. Pat. No. 3,882,921 discloses a roller screen assembly for covering an aperture, which; however, is not directed to implementing the retraction of a slot cover into a rolled up condition or which will permit the entire deployed system to be retracted. Moreover, there is no provision of slot cover structure forming a sealing arrangement in the deployed condition thereof so as to prevent any leakage, such as RF leakage during radar operation, between adjacent membranes or panels.

Van Alstyne U.S. Pat. No. 3,525,483 is concerned with a panel folding system in which a plurality of articulatedly interconnected panels may be selectively deployed to form an extended, substantially planar surface, or retracted into an accordian-like folded condition. As in the other art, there is no provision of an arrangement constituted of a deployable and retractable slot cover which, in the deployed condition thereof, will clampingly engage the edge portions of adjacent panels or membranes such as to form an overlapping sealing structure in conjunction with the panels, and which will prevent the passage of light, dust or moisture through any slot present between the panels or membranes, and in particular will inhibit any RF leakage through the slot during radar operation of an installation incorporating the panels.

SUMMARY OF THE INVENTION

Accordingly, in order to meet the demands of the technology for the provision of a slot cover deployment and retraction arrangement, the invention contemplates the utilization of a unique and novel slot cover structure extending across a slot or space existing between adjacent substantially parallel-spaced membranes or panels, and which will provide for an adequate degree of sealing of the slot between the membranes or panels. In essence, the slot cover structure includes an elongated cover member consisting of upper and lower cover portions which are centrally fastened to each other along the longitudinal axis thereof, and with the cover portions being configured in transverse cross-section such that, in the extended deployed position of the slot cover, the upper and lower cover portions have clamshell configurations extending from the central axis, whereby the outer edges of the cover portions come into surface-engaging clamping contact with the surfaces of the applicable membrane or panel which is interposed therebetween, so as to be in essentially slot closing or sealing relationship therewith, and to thereby inhibit any RF leakage through the slot present between the panels, during radar operation. Additionally, suitable deploying and retracting operating structure is provided, which is in operative communication with the slot cover so as to impart a separating action to the lateral edges of the upper and lower cover portions upon initiation of deployment or retraction of the slot cover to thereby prevent any frictional contact between the edges of the slot cover portions and the facing surfaces of the respective panel or membrane which is interposed between the slot cover portions, and thereby minimizing any membrane distortion which could lead to deployment failure or membrane damage. Moreover, this essentially frictionless deployment and/or retraction of the slot cover and of the membranes allows the slot cover to be employed for sealing the space or slot between extremely lengthy membranes.

Moreover, the inventive slot cover deployment and retraction arrangement provides significant advantages over existing and currently employed deployment and retraction devices of this type, in that:

(a) the slot which is present between adjacent membranes or panels can be readily sealed through the essentially clamping contact by the cooperating edges of the slot cover portions between which the membranes extend, without any necessity to provide for precise alignment of the respective membranes or panels;

(b) the edges of the membranes or panels do not require the provision of any specialized components, for example, as is the instance with a slide tape, thereby considerably simplifying the fabrication of the membranes or panels;

(c) there is no need to control the width of the slot which is present between adjacent membranes or panels, nor is there any requirement for adjacent membranes to be drawn or pulled together in a slide fastener or zipper-like manner, inasmuch as the slot cover can be made as wide as necessary such that the mating, laterally extending outer edges on the cover portions project over the edges of the membranes or panels extending therebetween to any expedient extent as required;

(d) any rubbing or sliding frictional contact between the surfaces of the membranes and the facing edge surfaces of the slot cover portions can be controlled so as to be maintained within tenable bounds or even completely eliminated during deployment or retraction of the slot cover, and resultingly minimizing any encountered membrane distortion which conceivably, could lead to deployment failure or to membrane damage;

(e) the substantially frictionless deployment or retraction of the slot cover allows the latter to be employed for sealing any slot or space which is present between very lengthy membranes or panels;

(f) the inventive slot cover does not require the provision of any permanent attachments to the membranes and, consequently, can be stored independently of the membranes thereby minimizing the normally encountered complexities for the storing, rolling or supporting of the membranes;

(g) the inventive arrangement does not impart any distorting forces or moments to the deployed membranes or panels; in essence, does not compromise membrane flatness.

In summation, the inventive slot cover deployment and retraction arrangement incorporating the novel slot cover structure and actuating devices for sealing the space or slot existent between adjacent panels or membranes provides significant and important advantages over the current state-of-the-art, and with an attendant simplicity of construction and operation, while providing an enhanced degree of sealing of the space or slot between the membranes.

Accordingly, it is an object of the present invention to provide for a novel and inventive slot cover deployment and retraction arrangement for effectively sealing the space or slot which is present between adjacent panels or membranes.

It is another object of the present invention to provide a slot cover deployment and retraction arrangement which will allow for an improved and simplified operation thereof and for the sealing of a slot or gap which is present between the membranes or panels.

Still another object of the present invention resides in the provision of an improved slot cover deployment and retraction arrangement facilitating the deployment and retraction of the slot cover in an essentially non-contacting or substantially frictionless manner with regard to the membranes, thereby protecting the integrity of the membranes and preventing deployment failure.

A further object of the present invention is to provide a slot cover deployment and retraction arrangement of the type described herein which allows for the simple and compact storage thereof, wherein the slot cover may be stored independently of the panels or membranes.

A still further object of the present invention is to provide a slot cover retraction and deployment arrangement of the type described, which will dependably inhibit any RF leakage during radar operation through a slot or gap present between adjacent membranes or panels, and in which the inherent sealing ability of the slot cover structure during deployment thereof may be employed to prevent any light, dust or moisture intruding between two adjacent membranes or panels.

Moreover, in dependence upon a suitable selection of the materials of the slot cover and the adjacent membranes or panels which are contacted by the slot cover, the arrangement is readily utilizable as a medium for transmitting electrical power or for establishing electrical continuity between adjacent membranes or panels.

BRIEF DESCRIPTION OF THE DRAWINGS

The foregoing and other advantages of the invention may be more readily ascertained from the following detailed description of a preferred exemplary embodiment thereof, taken in conjunction with the accompanying drawings generally diagrammatically illustrating the slot cover deployment and retraction arrangement; in which.

DETAILED DESCRIPTION OF A PREFERRED EMBODIMENT

Figure 1:
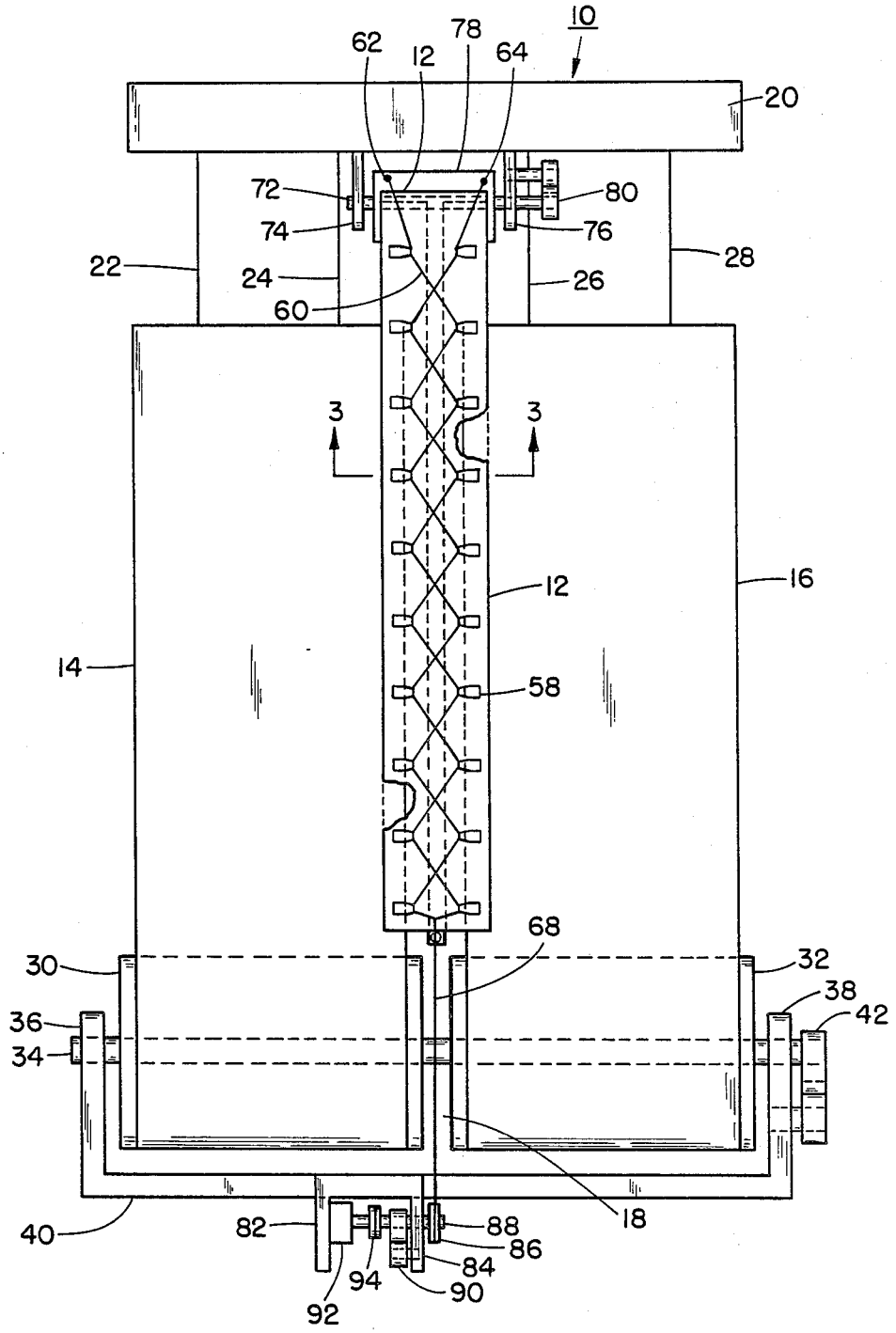
FIG. 1 illustrates a top plan view of the slot cover deployment and retraction arrangement pursuant to the invention, shown deployed in an extended position between two adjacent panels or membranes.

Referring now in detail to the drawings, and more particularly to FIGS. 1 through 7, FIG. 1 illustrates an overall plan view of an arrangement 10 for the selective deployment and retraction of a slot cover 12 for a pair of generally parallel, adjacent panels or membranes 14, 16.

In this instance, the membranes 14, 16 are elongated, generally rectangular members which extend in parallel so as to form a gap or slot 18 therebetween, and with one end, such as the upper end, of the membranes 14, 16 being attached to an end beam 20 supporting a plurality of membrane lanyards 22, 24, 26, 28 for fastening the membranes to the end beam.

The opposite or lower ends of the panels or membranes 14, 16 are respectively wound about membrane drums 30, 32 which serve as supports for the lower edges of the membranes, and which concurrently serve as storage drums for the membranes 14, 16, with the latter wound thereon, upon retraction of the membranes from their deployed extended position.

The end beam 20 extends in parallel with the membrane drums 30, 32, and is adapted to be translated towards the membrane drums during retraction of the slot cover 12 while remaining in parallel with the former.

The membrane drums 30, 32 which support the lower ends of the membranes are fixedly supported on a rotatable drum shaft 34 which, in turn, is rotatably journaled in supports 36, 38 at the opposite ends of a drum support beam 40, and wherein one end of the shaft extending beyond the support 38, mounts a membrane drum spring motor 42 thereon, and which is also fastened to the beam 40, for exerting a constant torque on the membrane drums 30, 32 in a direction which normally serves to induce tension in the membranes along their longitudinal axes.

Extending across the slot 18 between the membranes or panels 14, 16 in the deployed condition is the slot cover structure, as is shown in greater detail in FIGS. 4 through 8 of the drawings.

Figure 4:
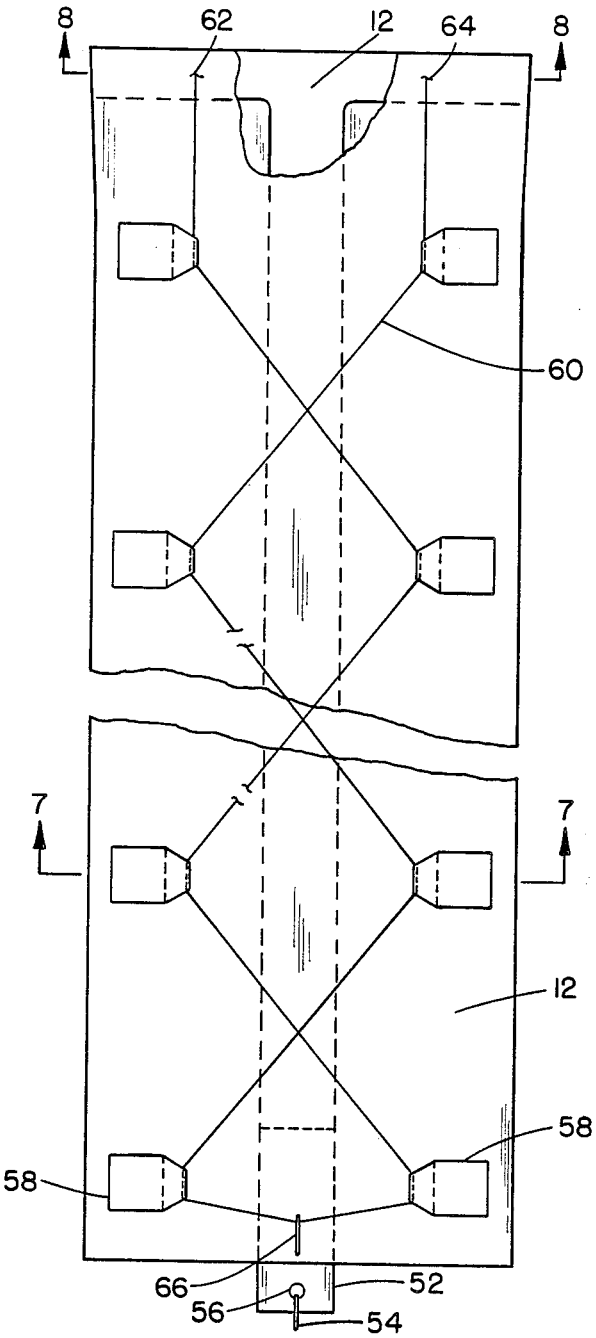
FIG. 4 illustrates, on an enlarged scale, a top plan view of the deployable and retractable slot cover structure utilized in the arrangement of FIG. 1.
Figure 5:
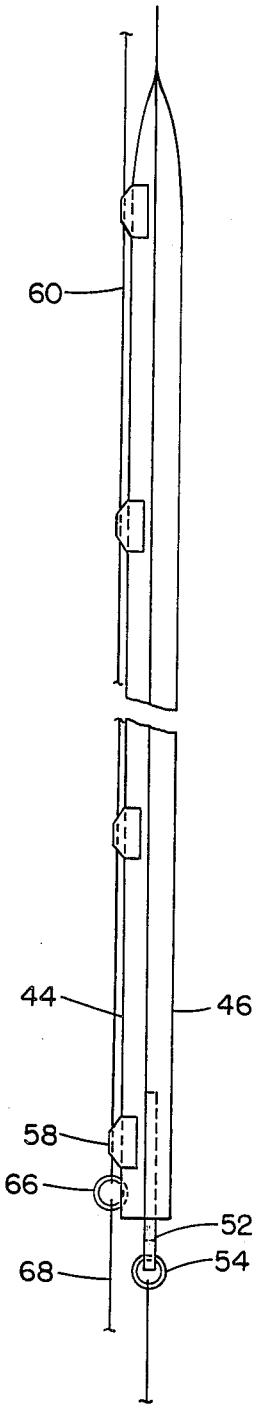
FIG. 5 illustrates a side view of the structure of FIG. 4.

Thus, referring more specifially to FIGS. 4 and 5, the slot cover 12 incorporates, in superposition, an upper cover portion 44 and a lower cover portion 46, each of which is constituted of an elongate rectangular molded or formed material possessing a substantially semi-rigid, resilient nature, with the upper cover portion 44 including downwardly arcing segments extending along its opposite longitudinal edges, whereas the lower cover portion 46 includes oppositely arcing segments so as to form clamshell-like configurations extending along the opposite edges thereof, with the resilient nature of the material of the cover portions 44, 46 normally biasing their mating edges together into a clamping engagement or contact.

The lower cover portion 46 is attached to the upper slot cover portion 44 generally along the central longitudinal axis thereof by means of either adhesive bonding, riveting, stapling, stitching, soldering or welding.

Figure 6:
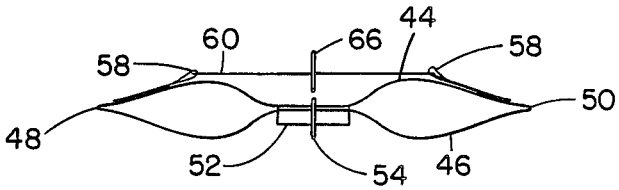
FIG. 6 illustrates an end view of the structure of FIG. 4.
Figure 7:
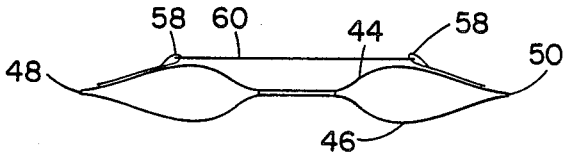
FIG. 7 illustrates a sectional view taken along line 7—7 in FIG. 4.

The material of each of the slot cover portions 44, 46, and especially the lower slot cover portion 46, may be constituted of a shaped metallic or molded non-metallic material, such as molded thermoplastic. If a non-metallic material is employed, it may be metalized on either one or both surfaces thereof. Thus, the normal configuration of the lower slot cover portion 46 may be such that, when it is attached to the upper slot cover 44, as shown in FIGS. 6 and 7, a positive spring force will be developed between the slot cover portions along the opposite contacting longitudinal free edges 48, 50 thereof.

A batten 52 is attached to the outer surface of the lower slot cover portion 46 so as to extend along the longitudinal central axis thereof, with a batten ring 54 being attached to the batten by passing through a hole 56 formed in the end extending towards the membrane drum support beam 40.

Fastened to the outer surface of the upper cover portion 44 in two oppositely facing rows spaced on both sides of the longitudinal central axis are a series of eyelets or loops 58 along the length of the slot cover 12, through which there is threaded a criss-crossing lace 60 starting and terminating at respective points 62, 64 proximate the end of the slot cover towards the end beam 20 subsequent to criss-crossing through all of the eyelets 58, and with the lace 60 passing through a lace ring 66 located between the eyelets at the opposite end of the upper slot cover portion 44.

A lace lanyard 68 is attached to the lace ring 66, whereas a batten lanyard 70 is attached to the batten ring 54 and to the drum support beam 40, for a functional purpose as described hereinbelow.

Figure 8:
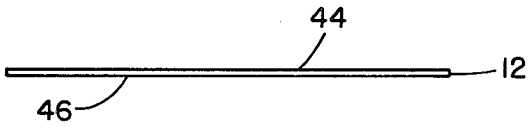
FIG. 8 illustrates a sectional view taken along line 8—8 in FIG. 4.

At the end of the slot cover portions 44, 46 at which there is attached the lace 60, proximate points 62, 64, as shown in FIG. 8, the slot cover portions may possess a substantially flat configuration.

A slot cover reel shaft 72 is rotatably journaled in a pair of spaced brackets 74, 76 fastened to the end beam 20 and extending towards the slot cover 12. A slot cover reel 78 in the shape of a cylindrical drum is fixedly mounted on the shaft 72, with the ends of the lace 60 near points 62, 64 being also attached to the cylindrical surfaces of the reel 78.

A cover reel spring motor 80 is attached to one projecting end of the slot cover reel shaft 72, and is also fastened to the bracket 76 on the end beam 20. This motor 80 exerts a constant torque on the cover reel 78 which is mounted on the shaft 72, in a direction so as to cause a tensile force to be exerted on the slot cover 12 in the longitudinal direction thereof. The drum support beam 40 incorporates a pair of spaced bracket members 82, 84 providing a bearing support for a lace reel 86 mounted on a lace reel shaft 88, a lace reel spring motor 90 which is fastened to shaft 88 and to bracket member 84, an actuator 92 and a clutch 94 on bracket member 82.

The lace reel 86 serves as a storage drum for the lace lanyard 68 of the upper slot cover portion 42, and with one end of the lanyard 68 being attached to the lace reel 86 which, in turn, is fixed to the lace reel shaft 88.

Figure 2:
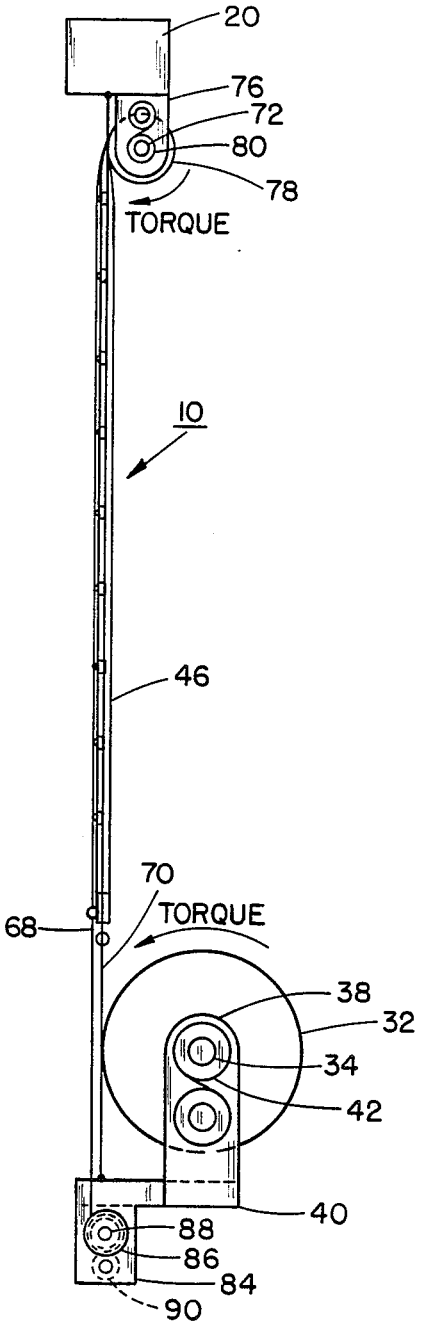
FIG. 2 illustrates a side view of the arrangement of FIG. 1.

The lace reel spring motor 90 exerts a constant torque on the lace reel 86 only when the clutch 94 is disengaged and the direction of torque is such that it tends to induce tension in the lace lanyard 68. Thus, when the clutch 94 is engaged, as shown in FIGS. 1 and 2 of the arrangement, the torque of the spring motor 90 is reacted by the clutch 94 and, as a result, the torque is not transmitted to the lace reel 68.

The clutch 94, as mentioned hereinbefore, serves to either engage or disengage the lace reel shaft 88, and can also be rotated by the actuator 92 in a direction which tends to relieve tension in the lace lanyard 68. The clutch 94 is operatively attached to the actuator 92.

The actuator 92 serves to translate the clutch 94 so that the latter can selectively either engage or disengage the lace reel shaft. Thus, when the slot cover arrangement 10 is deployed in the operative extended position thereof as shown in FIGS. 1 and 2, then the actuator 92 rotates the engaged clutch 94 in a direction which produces a relief of any tension on the lace lanyard 68. As a consequent of the resultant slackness in the lace lanyard 68, this permits the slot cover portions 44, 46 to remain closed along their edges 48, 50 so as to clampingly engage the edge surface portions of the membranes 14, 16 extending between the upper and lower slot cover portions 44, 46.

Figure 10:
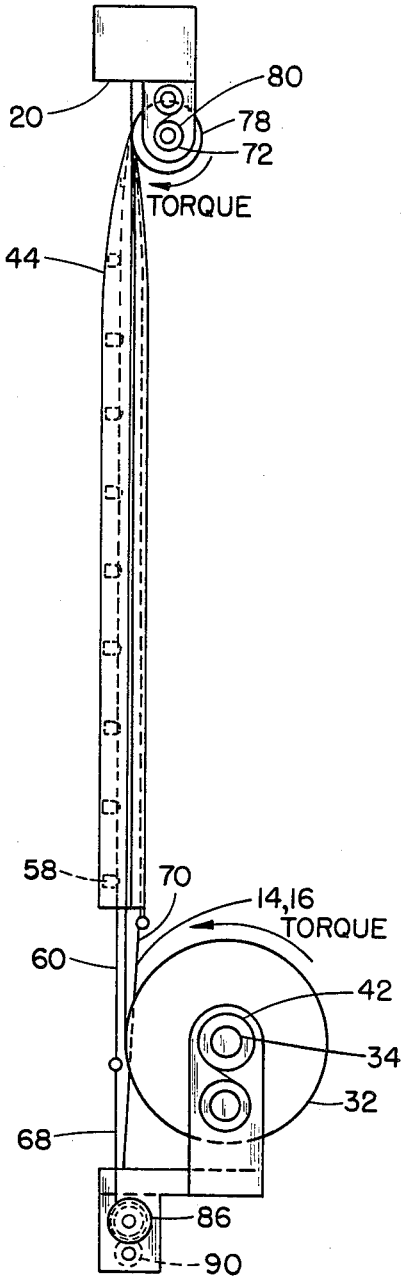
FIG. 10 illustrates a side view of the arrangement of FIG. 9.
Figure 11:
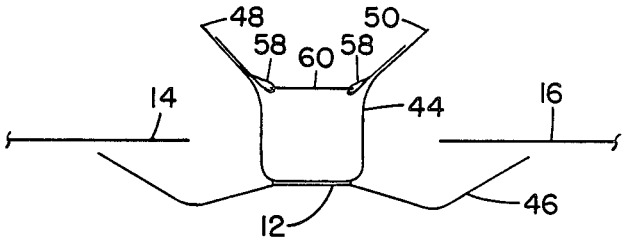
FIG. 11 illustrates a sectional view of the slot cover structure, on an enlarged scale, taken along line 11—11 in FIG. 9.
Figure 9:
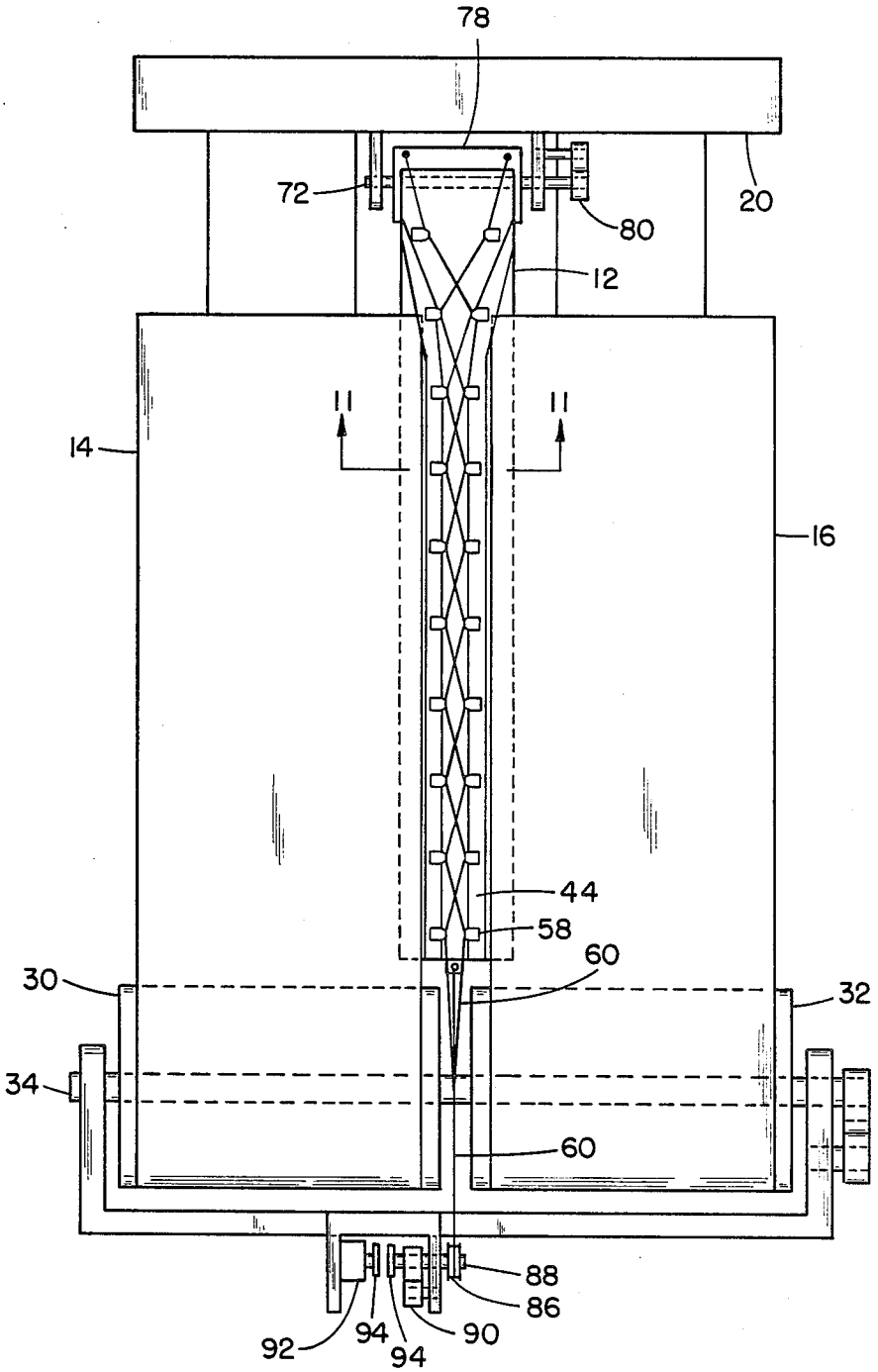
FIG. 9 illustrates a top plan view of the slot cover deployment and retraction arrangement in the deployed, but opened condition of the slot cover structure between two adjacent membranes.

Referring specifically to FIGS. 9 through 11 of the drawings, this shows the deployed and extended slot cover arrangement 10 in a position in which the slot cover portions 44, 46 are opened relative to each other; in essence, their edges 48, 50 are separated so as to release the membranes, and wherein the clutch 94 is in a disengaged position immediately prior to the retraction of the membranes.

The retracting sequence for the entire arrangement is basically as set forth hereinbelow:

With the entire slot cover arrangement 10 being in its extended and deployed condition; in effect, with the membranes 14, 16 clamped between the contacting edges of the upper and lower slot cover portions 44, 46, as shown in FIG. 1 of the drawings, the actuator 92 disengages the clutch 94 from the lace reel shaft 88. Thereafter, the lace reel spring motor 90 rotates the lace reel 86 in a direction which tends to take up the slack in the lace lanyard 68, and winds up the lanyard on the reel 86 until the lace 60 is tensioned.

The tensioned lace 60 then exerts a pull on all of the eyelets 58 which are attached to the upper surface of the upper slot cover portion 44. The pull exerted on the eyelets by the tensioned lace 60 draws the eyelets towards the longitudinal center axis of the slot cover and raises the edges of the upper cover portion 44 away from the lower slot cover portion 46 and from contact with the surfaces of the underlying membranes 14, 16. The clamping action of the slot cover 12 with the membranes is now eliminated, so that the membranes can be retracted without any appreciable frictional contact with the edges of the slot cover portions.

The extended end beam 20 is placed into translatory motion towards the membrane drums 30, 32, while being guided in parallel therewith. The drive unit for translating and guiding the end beam 20 during its retraction is not shown herein.

During the retraction of the end beam 20, the membranes 14, 16 roll up on the drums 30, 32 and remain tensioned because of the torque applied to the drum shaft 34 by the spring motor 42. The slot cover arrangement 10 is concurrently being rolled up upon the slot cover reel 78 because of the torque applied to the slot cover reel shaft 72 by the spring motor 80.

Figure 14:
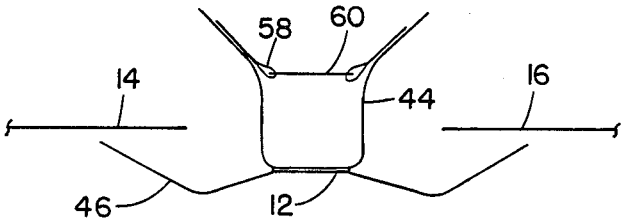
FIG. 14 is a sectional view, on an enlarged scale, taken along line 14—14 in FIG. 12.
Figure 13:
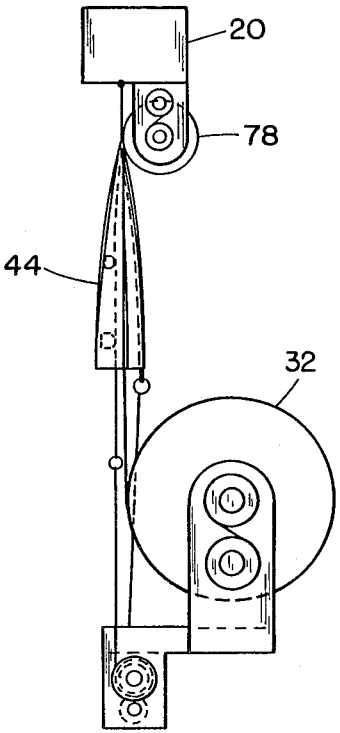
FIG. 13 illustrates a side view of the arrangement of FIG. 12.
Figure 12:
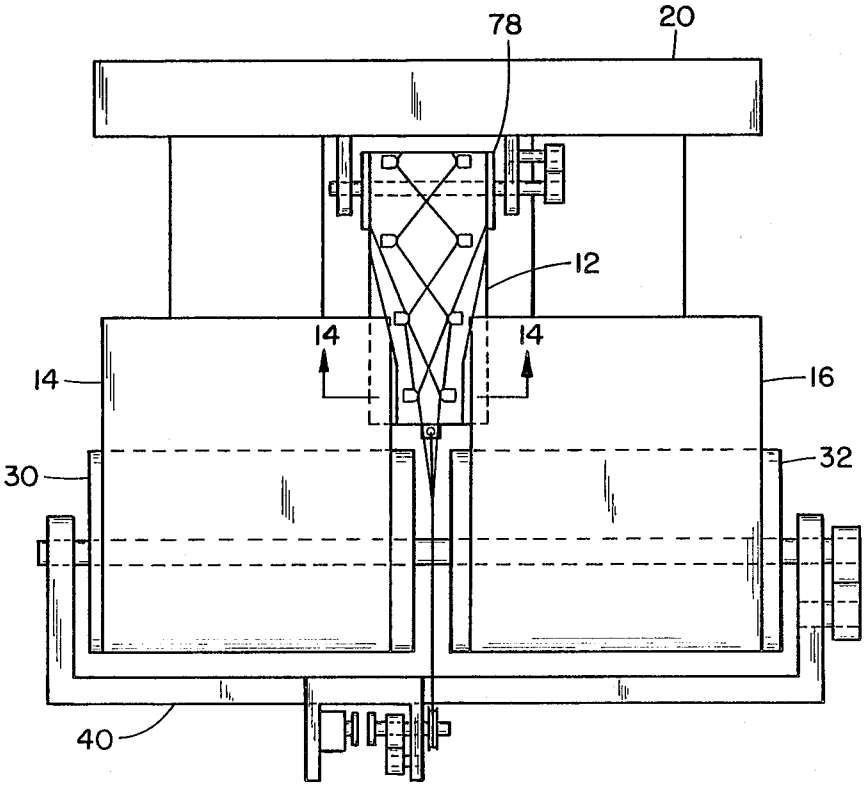
FIG. 12 illustrates a top plan view of the slot cover deployment and retraction arrangement in the opened and retracted condition thereof.

As shown in FIGS. 12 through 14 of the drawings, the fully retracted end beam 20, membranes 14, 16 and slot cover assembly 10 illustrate the slot cover 12 being pulled up on its reel 78 except for a short lead-in segment which remains unrolled. The membranes are concurrently rolled up on their membrane drums 30, 32, except for short lead-in segments which remain unrolled.

The sequence of subsequently again reextending the membranes and redeploying the slot cover assembly is as follows:

The end beam 20 is set into translatory motion to its extended deployed position, as shown in FIG. 9, and the slot cover assembly 10 unrolls from its reel 78. Concurrently, the membranes 14, 16 are also unrolled from the respective membrane drums 30, 32.

Figure 3:
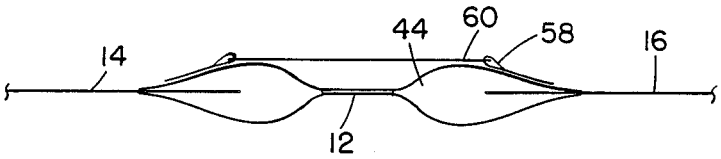
FIG. 3 illustrates, on an enlarged scale, a sectional view taken along line 3—3 in FIG. 1.

The actuator 92 engages the clutch 94 with the lace reel shaft 88 and rotates the shaft in the direction tending to produce a slack in the lace lanyard 68 and in the lace 60. Consequently, the elimination of the tension in the lace 60 removes the pulling action on the eyelets 58, and thereby allows the edges of the upper slot cover portion 44 to deflect downwardly until contact is made with the upper membrane surfaces, and biasing the membranes towards the lower slot cover portion 46 until the membranes are sealingly engaged between the edges 48, 50 of the slot cover 12, as shown in FIGS. 1 to 3 of the drawings.

From the foregoing it clearly appears that the present invention is directed to a simple and extremely versatile arrangement for selectively deploying and retracting a slot cover for covering a slot or space between adjacent panels or membranes, with all of the attendant advantages as described thereinabove.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A deployment and retraction arrangement for parallel extending panel-like membranes and for sealingly covering a slot between adjacent of said membranes in the deployed, extended position of said membranes; comprising:

(a) at least two parallel extending panel-like members and means for extending said membranes into said deployed condition to constitute essentially flat panels defining an elongated slot between the proximate edges of neighboring membranes and extending along the longitudinal length of said membranes;

(b) at least one elongate slot cover each having resilient biased engagement means along the longitudinal edges thereof, said biased engagment means engaging the adjacent edges of two respective membranes and sealingly closing the slot between said membranes in the deployed condition of said arrangement;

(c) means for disengaging the resilient biased engagement means of said slot cover structure from said membranes thereby enabling retraction of said membranes;

(d) means for retracting said membranes into a substantially rolled-up stowed position;

(e) and means for concurrently retracting said slot cover structure into a substantially rolled-up stowed position, whereby said arrangement is positioned in the retracted condition thereof.

2. An arrangement as claimed in claim 1, wherein said slot cover structure comprises an upper slot cover portion and a lower slot cover portion, said upper slot cover portion being superimposed on and coextensive with said lower slot cover portion; means for fastening said upper slot cover portion to said lower slot cover portion along the longitudinal central axes of said cover portions, said cover portions being resiliently biased towards each other along the longitudinal outer edges thereof so as to form said biased engagement.

3. An arrangement as claimed in claim 2, wherein said upper and lower slot cover portions are each convexly arced in transverse cross-section extending from the longitudinal central axis towards the outer edges so as to cause said edges to meet in clamping contact for sealingly engaging the surfaces of the membranes extending therebetween in the deployed condition of said arrangement.

4. An arrangement as claimed in claim 2, wherein said upper and lower slot cover portions are each constituted of a semi-rigid, flexible material.

5. An arrangement as claimed in claim 4, wherein at least one of said slot cover portions is constituted of a metallic material.

6. An arrangement as claimed in claim 4, wherein at least one of said slot cover portions is constituted of a molded thermoplastic material, said thermoplastic material having a metallized coating applied thereon adapted to contact the surfaces of said membranes.

7. An arrangement as claimed in claim 3, wherein said means for disengaging said resilient biased engagement comprise a plurality of eyelets fastened to the upper surface of said upper slot cover portions on both sides of the longitudinal central axis and spaced along the length of said cover portion; a lace extending in criss-crossing lacing relationship through said eyelets, one end of said lace being fastened to a first end of said cover portion; a lace lanyard being connected to said lace at a second end of said cover portion; and means for imparting tension to said lace for raising the edges of said upper slot cover portion away from the edges of the lower slot cover portions and from contact with said membranes.

8. An arrangement as claimed in claim 7, wherein a slot cover reel is fastened to said first end of said upper slot cover portion and to said lower slot cover portion; beam means rotatably supporting said slot cover reel; and motor means on said beam means for selectively retracting said slot cover structure onto said reel subsequent to imparting tension to said lace.

9. An arrangement as claimed in claim 8, wherein said means for retracting said membranes comprises drums for winding said membranes thereon; motor means for effecting the winding of said membranes onto said drums; and support means for rotatably mounting said drums and supporting said motor means.

10. An arrangement as claimed in claim 9, comprising clutch and actuator means mounted on said support means; lace reel means on said support means connected to said lace lanyard; and operative means responsive to said clutch and actuator means for selectively tensioning said lace prior to retraction or deployment of said membranes so as to inhibit frictional contact between the edges of said slot cover portions during retraction or deployment of said membranes.

* * * * *